US005289164A

United States Patent [19]

Novak

[11] Patent Number: 5,289,164

[45] Date of Patent: Feb. 22, 1994

[54] GLOVE TYPE HOLDER FOR SECURITY DEVICE

[75] Inventor: Patrick J. Novak, St. Paul, Minn.

[73] Assignee: BooFoo Ideas, Inc., Eagan, Minn.

[21] Appl. No.: 916,907

[22] Filed: Jul. 20, 1992

[51] Int. Cl.[5] ..... G08B 15/02

[52] U.S. Cl. ..... 340/574; 116/DIG. 44; 200/DIG. 2; 340/693

[58] Field of Search ..... 340/574, 693; 200/DIG. 2; 116/DIG. 44

[56] References Cited

U.S. PATENT DOCUMENTS

| | | | |
|---|---|---|---|
| 1,906,193 | 4/1933 | Vitale | 200/DIG. 2 |
| 2,516,180 | 7/1950 | Brown | 200/DIG. 2 |
| 3,825,833 | 7/1974 | Bogue et al. | 340/574 |
| 4,223,804 | 9/1980 | Morris et al. | 116/DIG. 44 |
| 4,843,336 | 6/1989 | Kuo | 340/693 |
| 5,005,002 | 4/1992 | Halperin | 340/693 |
| 5,032,824 | 7/1991 | Corbin | 340/574 |
| 5,177,467 | 1/1993 | Chung-Piao | 340/693 |

*Primary Examiner*—Glen R. Swann, III

*Attorney, Agent, or Firm*—Westman, Champlin & Kelly

[57] ABSTRACT

A protection apparatus aids a user of the apparatus in defending against an attacker and signals that the user is being attacked. The protection apparatus attaches a spray retardant and an alerting device to the user of the apparatus and includes a trigger mechanism that activates both the spray retardant and the alerting device substantially simultaneously. The trigger mechanism is capable of being activated by a single digit of a hand of the user.

23 Claims, 2 Drawing Sheets

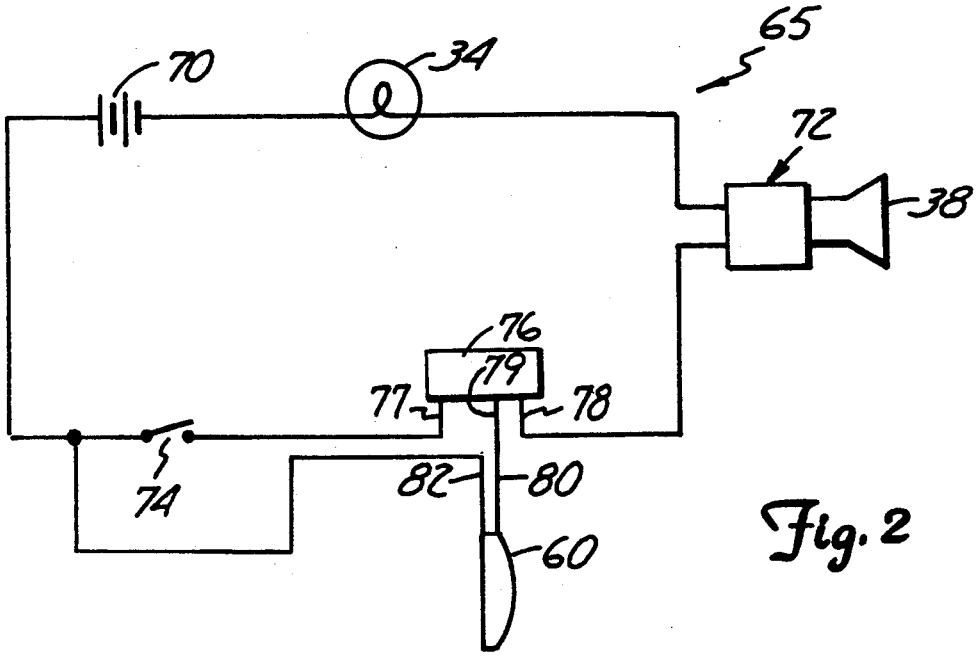
Fig. 2
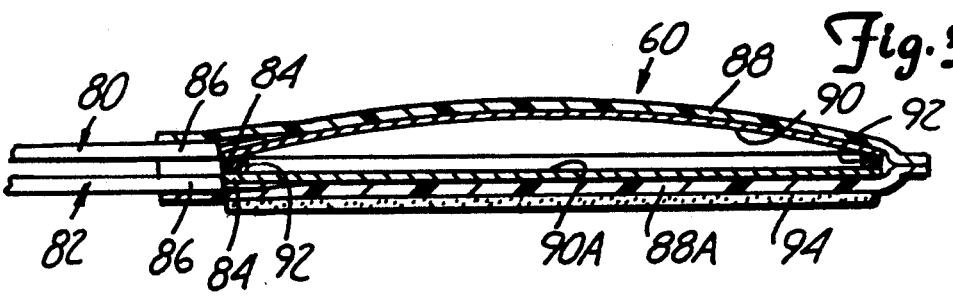
Fig. 3A
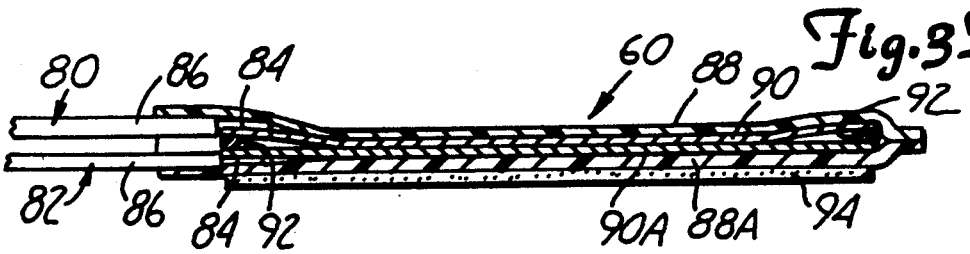
Fig. 3B
Fig. 4
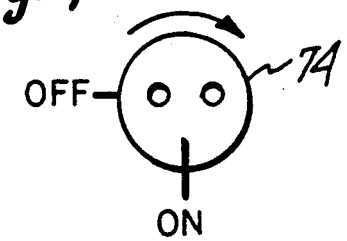

GLOVE TYPE HOLDER FOR SECURITY DEVICE

BACKGROUND OF THE INVENTION

The invention relates generally to protection devices, and, more particularly, to protection devices which can be carried by the user of the device.

Presently, many products exist which can be used by a potential victim as protection devices to defend against an assault from an attacker. For example, high pitched sirens or alarms are available which can be carried in a purse and which may be turned on by the victim to alert others that the victim is being attacked. The activation of the high pitched siren is also used to deter a potential attacker. Additionally, cans small enough to fit in a purse and filled with a spray such as Mace or tear gas (called spray retardants) are readily available and can be used by the victim in defending against the attacker.

SUMMARY OF THE INVENTION

The present invention relates to a protection device which aids a user of the device in defending against an attacker and signals that the user is being attacked. The device attaches an alerting horn or siren to a holder worn by the user of the device. As shown, a spray retardant is thus carried directly by the user. A trigger mechanism is provided for activating both the spray retardant and the alerting siren substantially simultaneously. The trigger mechanism is capable of being activated by a single digit of the user, which is close to the trigger when the device is worn.

In a preferred embodiment of the present invention the protection device attaches both a high intensity light and a high pitch siren to the holder worn by the user. After the trigger mechanism is activated by the user, the high intensity light and the siren are locked on. The light and the siren are capable of being shut off with a special key.

In the preferred embodiment of the present invention the spray retardant, the siren, and the light are attached to a glove or mitt-like article and are worn on a hand of the user. The glove includes a hook and loop fastener for holding a strap on the glove around a wrist of the user.

BRIEF DESCRIPTION OF THE DRAWINGS

FIG. 2 is a schematic diagram of the electrical connections of the present invention;

FIGS. 3A and 3B are cross-sectional views of a membrane switch of a trigger mechanism of the protection device of FIG. 1; and FIG. 4 is plan view of a keyed on/off switch that is schematically shown in FIG. 3.

DETAILED DESCRIPTION OF THE PREFERRED EMBODIMENTS

Figure 1:
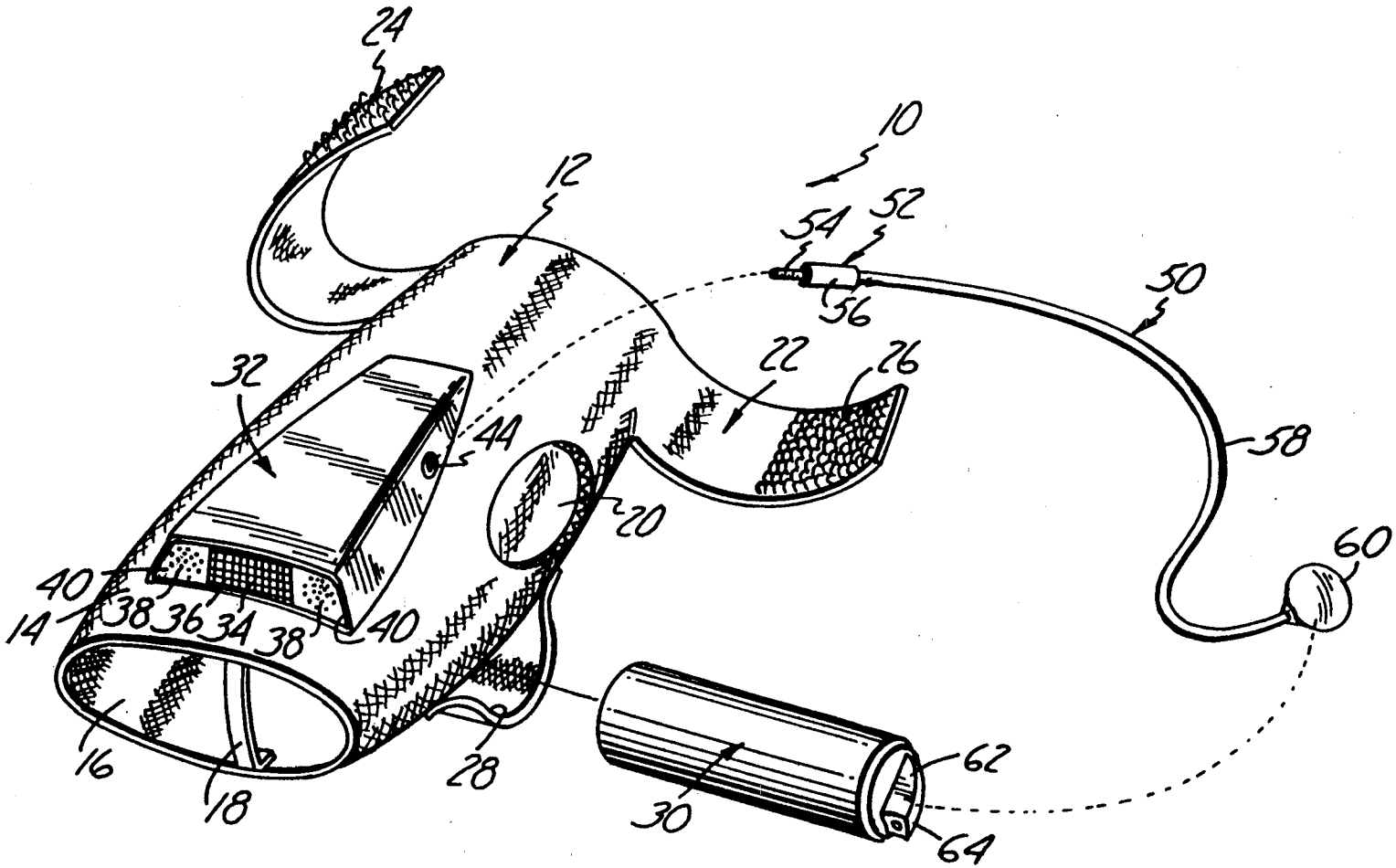
FIG. 1 is a perspective view of a protection device according to the present invention.

A protection device which aids a user of the device in defending against or warding off an attacker and signals that the user is being attacked is generally indicated at 10 in FIG. 1. Protection device 10 is capable of being worn by the user of the device.

Protection device 10 includes a glove or mitt 12 which wraps around a hand of the user and attaches protection device 10 to that hand of the user. Glove 12 is preferably made from a stretchable elastic material such as a spandex fabric which does provide some resistance to stretching. In addition, in one preferred embodiment of the invention glove 12 is made with a fluorescent spandex fabric in order to be highly visible. A glove body 14 of glove 12 fits around the palm of a hand of the user. A finger hole 16 of glove 12 provides an opening for the user's fingers to extend through. A strap 18 provides a separation between the index finger and the other three fingers of the hand in which device 10 is attached. Strap 18 stabilizes the position of glove 12 on the hand of the user. A thumb hole 20 of glove 12 provides an opening for the user's thumb. The glove 12 illustrated in FIG. 1 is constructed to fit on the right hand of the user, and leaves the fingers and thumb exposed for ease of use.

Glove 12 further includes a wrist strap 22 that attaches around a wrist of the user for securing device 10 to the user. Wrist strap 22 is typically fastened around the wrist with a hook and loop fastener which includes a hook portion 24 and a loop portion 26. Hook portion 24 and loop portion 26 are releasably attachable to each other. A suitable hook and loop fastening system is sold under the trademark VELCRO. As with the other sections of glove 12, wrist strap 22 is preferably made of a stretchable material such as spandex to allow the wrist strap to be tightly attached around the wrist of the user and fastened with the hook and loop fastening system. In this way, glove 12 can be securely attached to a variety of hand sizes.

The palm of glove 12 has a pouch 28 formed therein which extends downwardly from the palm side of glove body 14. A container 30 filled with spray retardant is insertable into pouch 28. Pouch 28 is also preferably made from an elastic material such as spandex because pouch 28 needs to tightly fit around container 30 in order to hold container 30 in the palm of the hand of the user. In addition, it is preferred that pouch 28 accommodate a reasonable range of container 30 sizes and shapes and yet hold the container securely in the pouch.

A compartment 32 is formed on the upper or back side of glove 12. Compartment 32 includes an outer housing which is preferably made from a high impact plastic. A high intensity light 34, which is not shown in FIG. 1, is held in the front center portion of compartment 32 of the housing 33. High intensity light 34 shines through a window 36 disposed in the front portion of compartment 32. Window 36 is made from a transparent material such as a high impact transparent plastic. Two high pitched siren speakers 38, which are not shown in FIG. 1, are also disposed in housing 33 adjacent to light 34 in the front portion of compartment 32. Two front walls 40 are positioned on the sides of window 36 to form the front of compartment 32 and to cover the speakers 38. Walls 40 are preferably made from the same high impact plastic as the rest of compartment 32. Walls 40, however, contain holes to allow sound from speakers 38 to pass to the outside of compartment 32.

A trigger mechanism is generally illustrated at 50 in FIG. 1. Trigger mechanism 50 includes a plug 52. Plug 52 comprises a threaded conductive member 54 and an insulating portion 56. Conductive member 54 screws into a threaded trigger socket 44 to mechanically lock conductive member 54 into socket 44, which prevents a third person from simply disconnecting the member from the socket by pulling on trigger mechanism 50. Socket 44 is disposed in the thumb side and toward the rear of compartment 32. Socket 44 is electrically coupled into a circuit 65, which is schematically illustrated in FIG. 2 and which includes speakers 38 and light 34. Trigger mechanism 50 also includes an insulated wire 58 which is electrically connected to and extends from plug 52. Wire 58 could be directly soldered into circuit 65 instead of using plug 52 to electrically couple trigger mechanism 50 into circuit 65. A switch 60 is electrically connected to the opposite end of wire 58 from which plug 52 is connected. As indicated in FIG. 1, switch 60 is adhered to an activation button 62 of spray retardant container 30. When pressure is applied to button 62, spray retardant is gas-propelled from container 30. Switch 60 is preferably adhered to a top portion 64 of button 62 with a pressure sensitive adhesive.

The operation of the electrical circuit 65 of protection device 10 is schematically illustrated in FIG. 2. A 1.5 volt battery 70 supplies power to light 34 and a siren 72. Siren 72 is connected to the pair of speakers 38. A thyristor 76 is coupled in series into the circuit at leads 77 and 78 of the thyristor. A mechanical keyed switch 74 is also coupled in series into the circuit between the battery 70 and lead 77 of thyristor 76. The switch 60 is coupled into the circuit across the battery node of switch 74 and a lead 79 of thyristor 76. In the normal operation of device 10, mechanical keyed switch 74 is in a closed or on state to provide an electrical connection across the switch. In contrast, thyristor 76 normally provides an open circuit between leads 77 and 78 of the thyristor causing the circuit to be in an off state causing light 34 and siren 72 to be shut off. Many forms of thyristors are commercially available, but, in general, they are open circuits capable of withstanding some rated voltage until triggered by sending current through a thyristor gate indicated by lead 79 of thyristor 76. Once triggered, the thyristor 76 becomes a low impedance current path even after the trigger source is removed and returns to an open circuit only after current through the thyristor leads 77 and 78 is reduced below a minimum holding level.

When a user wants to activate the defense and alerting (deterrent) capabilities of protection device 10, the user needs to close switch 60 which sends the needed current through the gate of thyristor 76 via lead 79 to turn on the thyristor. An open switch 60 is generally illustrated in FIG. 3A. An input insulated wire 80 is connected to one terminal of switch 60 and an output insulated wire 82 is connected to the other terminal of switch 60. Wires 80 and 82 couple switch 60 into circuit 65, as illustrated in FIG. 2. Wires 80 and 82 both include an inside conductor 84 and an insulator 86 which surrounds conductor 84. Switch 60 comprises an upper outer insulator layer 88 and a lower outer insulator layer 88A. An upper conductive layer 90 is adhered to the interior side of insulator layer 88 and a lower conductive layer 90A is adhered to the interior side of insulator layer 88A. Layers 90A and 88A are substantially flat. By contrast, layers 90 and 88 are bowed and elastic and form a bubble over layers 90A and 88A. A perimeter insulator material 92 is disposed between layers 90 and 90A at the outer edges of the conductive layers. Conductor 84 of wire 80 is electrically connected to conductive layer 90. Conductor 84 of wire 82 is electrically connected to conductor 90A. Because insulator material 92 separates conductive layer 90 and 90A at the perimeter of the layers and because layer 90 is bowed above layer 90A, switch 60 is normally open. Conductive layers 90 and 90A are made of thin conductive films which make electrical contact when the layers contact under manual pressure sending current to lead 79 of thyristor 76. Switch 60 is called a membrane switch and such switches are commercially available in either tactile or nontactile forms. A tactile switch enables the user to feel when sufficient pressure is applied to close the switch. FIG. 4B illustrates switch 60 after a sufficient pressure is applied to upper layer 88 of the switch causing a permanent closing of the switch.

Since switch 74 is normally closed, once switch 60 triggers thyristor 76 to become a low impedance current path, both light 34 and siren 72 will be activated. Furthermore, a pressure sensitive adhesive 94 adheres switch 60 to the top portion 64 of button 62. Consequently, when the user applies pressure to close switch 60, the user will also press down button 64 which will gas propel the retardant spray from container 30. The retardant spray can be Mace or tear gas or other disabling or distracting chemicals. As illustrated in the preferred embodiment of FIG. 1, the user can easily activate switch 60 and button 64 with the user's thumb as a result of the relative placement of thumb hole 20 and pouch 28 in glove 12. Thus, by merely pressing down on switch 60 with a thumb, the user can activate deterrent devices such as a high pitch siren, a high intensity light, and/or a chemical spray deterrent or retardant such as Mace.

Device 10 is provided with an emergency unlocking switch 74 so that the high pitch siren and the high intensity light can be shut off after the siren and light are activated with the triggering of switch 60 because thyristor 76 will not become an open circuit until essentially no current is flowing through leads 77 and 78. As illustrated in FIG. 5, switch 74 is a common mechanical keyed switch which can be shut off only with a special key similar to handcuff keys. In this way, only the police or similar authorities would have access to shut off the device. Access to switch 74 is provided underneath compartment 32 through a hole in the spandex fabric that comprises glove 12. Thus, the glove needs to be removed from the user in order to deactivate the device.

Wearing the glove insures that the deterrent is firmly held and readily accessible. Once the glove is put on, the container 30 is held securely and will not be put away or misplaced. Moreover, the protection device does not substantially interfere with use of the fingers and thumb for other tasks. Thus, the glove will not be taken off because of inconvenience. As a result, the deterrent is always readily available if needed. The natural tendency to close the hand insures that the unit will be held secure while being actuated with the thumb.

The protection device can be worn by children and adults for use under a wide variety of circumstances. The container filled with deterrents can be made quite small and actually flattened from the form shown. Full finger gloves can also be used in cold weather.

Although the present invention has been described with reference to preferred embodiments, workers skilled in the art will recognize that changes may be made in form and detail without departing from the spirit and scope of the invention.

What is claimed is:

1. An apparatus which provides a defense against assault comprising:

an alerting device; and attachment means for attaching the alerting device to a hand of a user of the apparatus, and having means for attaching a container of spray retardant to the attachment means.

2. The apparatus of claim wherein the attachment means includes a member to fit over the palm of a hand of the user.

3. The apparatus according to claim 1 wherein the attachment means includes a hook and loop fastener having a first portion containing a plurality of hooks and a second portion containing a plurality of loops which are releasably attachable with the hooks around the wrist of the user of the apparatus.

4. The apparatus according to claim 1 further comprising:

trigger means for activating both the spray retardant and the alerting device substantially simultaneously.

5. The apparatus according to claim 4 wherein the trigger means is capable of being activated by a single digit of the user.

6. The apparatus according to claim 5 wherein the trigger means includes means for locking the alerting device in an on position.

7. The apparatus according to claim 6 further comprising:

a separate key-actuated, normally on switch.movable to shut off the alerting device.

8. The apparatus according to claim 1 wherein the alerting device comprises a siren.

9. The apparatus according to claim 1 wherein the alerting device comprises a light.

10. A method of protecting a person from an assault comprising:

attaching a siren and a deterrent spray to the body of the person; and attaching a trigger mechanism on the person which allows the person to activate both the siren and the deterrent spray substantially simultaneously with a single digit of a hand.

11. The method according to claim 10 further comprising:

locking the siren in an on state when the person activates the siren and the deterrent spray.

12. The method according to claim 11 further comprising:

shutting off the siren from the locked on state with a key.

13. The method according to claim 12 further comprising:

attaching a light to the body of the person which is capable of being turned on substantially simultaneously with the activation of the siren and the deterrent spray with the single digit of a hand, the light being locked on after the light is activated and being capable of being shut off from the locked-on state with a key.

14. A protection device which aids a user of the device in defending against an attacker and signals that the user is being attacked, the device comprising:

an article of clothing worn by the user for attaching the device to the body of the user;

defense means for defending against the attacker;

signalling means for both deterring the attacker and signalling for outside help; and trigger means for activating both the defense means and the signalling means, and being capable of being activated by a single digit of the user.

15. The device according to claim 14 wherein the trigger means includes means for locking the signalling means in an on position.

16. The device according to claim 15 further comprising:

a separate key-activated normally-on switch movable to shut off the signalling means.

17. The device according to claim 14 wherein the article of clothing is capable of attaching the device to a hand of the user.

18. The device according to claim 14 wherein the defense means includes a spray retardant which is gas propelled from a container when the trigger means is activated.

19. The device according to claim 18 wherein the trigger means includes a switch for activating the signalling means which is adhered to an activation button of the container holding the spray retardant to allow the signalling means and the spray retardant to be activated substantially simultaneously when the trigger means is activated by the user.

20. The device according to claim 14 wherein the signalling means comprises a siren.

21. The device according to claim 14 wherein the signalling means comprises a light.

22. An apparatus which provides protection for a user of the apparatus against assault, comprising:

a support worn on a hand of the user in the palm region;

a deterrent device supported on the support in the palm region of the hand; and an actuator button on the deterrent device positioned to the side of the palm adjacent the thumb which is capable of activating the deterrent device when depressed with the thumb.

23. The apparatus according to claim 22 further comprising:

a compartment worn on the back of the hand of the user;

an alerting device disposed in the compartment; and a switch capable of activating the alerting device which is adhered to the actuator button on the deterrent device to allow the alerting device and the deterrent device to be activated substantially simultaneously when the actuator button is depressed with the thumb.

* * * * *